United States Patent [19]

Atkinson

[11] 3,997,281

[45] Dec. 14, 1976

[54] VANED DIFFUSER AND METHOD

[76] Inventor: Robert P. Atkinson, 7814 Knue Road, Indianapolis, Ind. 46250

[22] Filed: Jan. 22, 1975

[21] Appl. No.: 542,916

[52] U.S. Cl. ..... 415/207; 415/211

[51] Int. Cl.[2] ..... F04D 29/44

[58] Field of Search ..... 415/211, 207

[56] References Cited

UNITED STATES PATENTS

| | | | |
|---|---|---|---|
| 1,119,713 | 12/1914 | Moss | 415/211 |
| 2,967,013 | 1/1961 | Dallenbach et al. | 415/211 |
| 3,150,823 | 9/1963 | Adams | 415/211 |
| 3,860,360 | 1/1975 | Yu | 415/211 |

FOREIGN PATENTS OR APPLICATIONS

| | | | |
|---|---|---|---|
| 1,202,624 | 8/1960 | United Kingdom | 415/211 |

OTHER PUBLICATIONS

Publication by Austin H. Church titled Centrifugal Pumps and Blowers, pp. 16–20; 118–128, copyright, 1944.

*Primary Examiner*—Henry F. Raduazo

[57] ABSTRACT

My invention relates to centrifugal compressors, more particularly to compressors of a known type, in which air enters the compressor rotor parallel to its axis of rotation, engages an inducer portion of the compressor rotor blades which is generally helical, in which the air is accelerated tangentially, and then proceeds through an impeller portion of the rotor formed with substantially radial vanes in which the air is further accelerated tangentially, leaving the rotor periphery with a high tangential velocity. In such a compressor, the air discharged from the rotor is received in a diffuser in which the velocity head of the air is largely converted to static head by a so-called diffusion process of reducing the air velocity. The air is then directed to the outlet or outlets of the compressor. It is to be understood, however, that this invention is concerned not with the rotor but rather with the vaned portion of the diffuser.

The principle object of my invention is to increase the compressor efficiency and essentially eliminate surge problems, thereby reducing the power required to drive the compressor which results in various advantages to any machine that requires a continuous flow of high pressure air.

This objective is achieved by several features. First, by defining a method to design the shape of the leading edge of the diffuser vanes, thereby reducing the entering shock loss and also the down stream flow separation; second, by defining a method of shaping the vanes and the passage walls such that the shape will cause a suitable rate of pressure rise that will also lessen the causes of flow separation from the passageway, thereby permitting stable operation, without compressor surge, in an operating regime having a higher compressor efficiency.

2 Claims, 6 Drawing Figures

VANED DIFFUSER AND METHOD

BACKGROUND OF THE INVENTION

1. Field of the invention

This invention relates to the field of air compression for a steady flow operating requirement. It also relates to the compression of other gases and will even apply to the pumping of liquids. More particularly, this invention relates to the compressors for superchargers and gas turbine type engines. This disclosure cites the application in a radial flow type compressor but it may be applied, also, to an axial flow compressor.

2. Description of the prior art

So far as is known the simple and improved diffuser described and claimed herein has not been known heretofore. To those skilled in the art, the importance of obtaining high compression efficiency without a significant surge problem are generally known. Other inventions cited herein illustrate previous efforts to advance this art. In most compressor applications, the flow capacity of the compressor must be matched closely with the flow capacity of the machinery which uses the fluid being compressed to avoid the surge problem. Some of the most common applications are in superchargers for piston engines and air compressors for gas turbine engines.

The problem of compressor surge resulting from unstable flow in a specific operating regime is well known. One example of a method of overcoming the surge problem is disclosed in C. A. Macaluso Et Al U.S. Pat. No. 3,069,070, Dec. 18, 1962. This method requires a variable geometry diffuser which consists of many moving parts and also requires some compromise from an optimum passage shape, which therefore does not gain as much compressor efficiency and is more expensive. Another example is disclosed in Thompson U.S. Pat. No. 2,399,072, Apr. 23, 1946. This method also requires considerably more complication and expense.

Other patents which describe related devices are as follows:

| United States Patents Cited | | |
|---|---|---|
| 3,778,186 | 12/1973 | Bandukwalla |
| 3,333,762 | 8/1967 | Vrana |
| 2,967,013 | 1/1961 | Dallenbach Et Al |
| 2,708,883 | 5/1955 | Keller Et Al |
| 2,596,646 | 5/1952 | Buchi |

The above do not include the important improvements which this invention discloses, and which past experience has shown will give significant improvements. This invention discloses a method of calculating and designing diffuser vanes and passages that constitutes an advancement to the centrifugal compressor art.

Some examples of research reports which are associated with the problems described in this disclosure and which lend support to the logic of this invention, are as follows:

| Literature References | |
|---|---|
| REF. 1) | Abott, I. H., Von Doenhoff, A. E. Theory of Wing Sections, Dover Pub. Inc. |
| REF. 2) | Fox, R. W., Flow Regime Data and Design Methods for Curved Subsonic Diffusers, Oct. 1960. Stanford University |
| REF. 3) | National Advisory Committee for Aeronautics. Report 1135. Equations, Tables and Charts for Compressible Flow. |

REF. 1 presents the performance test results of a large number of airfoil shapes for aircraft wings, in a high velocity air stream at various inflow angles. My invention utilizes this technology, since diffuser vane leading edges are similarly exposed to a wide range of air inflow angles, which is a major cause of performance loss and compressor instability, commonly referred to as surge.

An example of a method of reducing this loss in centrifugal compressor is disclosed in Atkinson U.S. Pat. No. 2,819,012, Jan. 1958. While that invention is intended to improve the impeller performance, the art described in that patent also improves the radial flow velocity distribution leaving the impeller outer diameter. This reduces the variation in inflow angle into the diffuser vanes along the length of the leading edge, thereby improving the diffuser efficiency and reducing the tendency to surge.

REF. 2 is an example of research which presents the results of flow bench laboratory testing on curved diffuser passage shapes, in which is cited the importance of avoiding a high pressure gradient in a diffuser. In nearly all current diffuser designs made for the type compressor to which this invention relates, there is a severe pressure gradient following the entrance to the diffuser passage, which is contrary to these findings. The reason that this problem can readily exist is explained by a study of Table I in REF. 3 which applies to the flow of a compressible fluid such as air. This shows that at Mach 1.0, (100 percent of the velocity of sound) a 1 percent increase in channel area results in a 9 percent decrease in velocity and a 12 percent increase in static pressure (neglecting friction losses). Nearly all current diffuser designs embody an excessively rapid increase in passage area, which is thus undesirable.

This invention takes this phenomenon into consideration and discloses a method of calculating this pressure gradient and gives limiting values for this parameter to prevent early flow separation, thereby permitting operation over a broad range that would otherwise cause a performance loss and surge.

SUMMARY OF THE INVENTION

A principal feature of the embodiment of this invention is the method of defining the rate of area increase in the diffuser passages such that the static pressure will increase at a specified rate which will prevent premature surge. This results in an operating line having a higher adiabatic efficiency than would otherwise be achieved.

This performance advantage is further augmented by defining the proper curvative of the diffuser vanes and leading edge shape which in combination with the side wall shape achieve the required area schedule.

These features used separately, but more especially in combination will improve the diffuser performance and greatly simplify and reduce the development cost for centrifugal compressors because the exact location of the surge line is not critical.

These and other objects of this invention will become apparent from a study of the following disclosure in which reference is directed to the attached drawings.

DESCRIPTION OF PREFERRED EMBODIMENT

The centrifugal compressor to which this invention applies is the well-known type having a so-called radial blade impeller and a radial vaned diffuser. These compressors have many applications. Two of the most common are to supercharge piston engines, and as one of the major components of a gas turbine engine. This invention discloses methods of improving compressor efficiency and overcoming compressor surge problems in essentially all applications.

With these improvements incorporated in the compressor, the power of such an engine can be substantially increased or the engine can be made smaller and lighter. A further very important advantage is that the engine fuel consumption can be decreased in terms of fuel used per horsepower-hour and the development time and cost can be reduced because of the lack of surge sensitivity.

Figure 1:
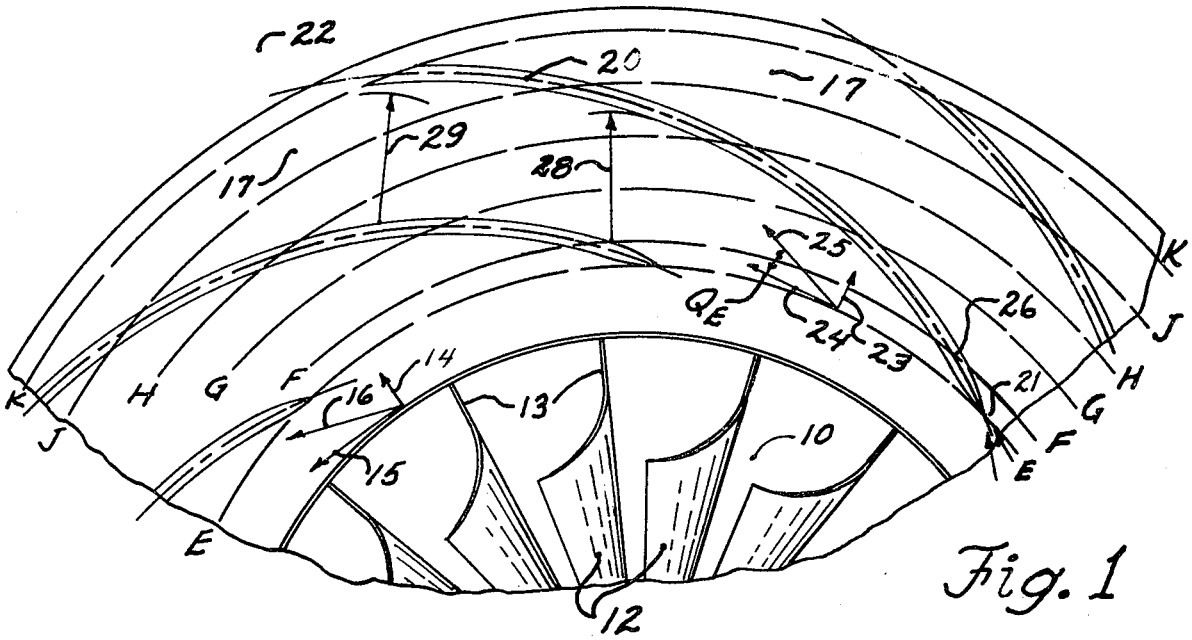
FIG. 1 is a partial radial section of a centrifugal compressor, taken perpendicular to the axis of rotation of the rotor showing the rotor and the diffuser with the inlet cover removed.

Referring to the drawings, FIG. 1 is a view primarily showing the diffuser vanes to which this invention relates. This shows an axial view of FIG. 2, having the inlet cover removed, thus exposing to view the impeller and the diffuser vanes. Although this type compressor is well known, the following description will clarify the drawings and some of the unique features of the parts as analyzed in this invention.

A rotor 10 turns on an axis 11. Air enters the rotor inducer blades 12, then turns and flows radially between the blades 13 and exits the impeller with a radial velocity 14 relative to the impeller. The rotating action of the impeller upon the air has imparted a tangential component 15. The resulting velocity from the combined effects of the velocity components 14 and 15 is the absolute velocity 16 with respect to the casings. After the air leaves the impeller with velocity 16, it flows in a free-vortex spiral across the vaneless diffuser annulus where the velocity is partially reduced. This is the first step of the diffusion process. It then enters the vaned passages which are formed by the side walls 18 and 19, and the spiral diffuser vanes 20, which are usually supported by one or both side walls. When the air approaches the point 21, of the leading edge of the diffuser vanes, the direction of approach varies considerably due to the fact that the velocity vectors 14 and 15 vary, partially due to the impulses of the impeller blades. It also varies across the blades, in a direction parallel to the rotor axis, for other reasons. To accommodate this variation the leading edge of the diffuser vanes, in this invention, is shaped as shown in the enlarged views FIG. 4 and FIG. 6. The design of these will be explained later.

As the air flows through the diverging passages 17, the passage area increases, in a manner unique to this invention, to decrease the velocity, that is, to diffuse the air, thus causing the static pressure to further rise. The schedule for defining the change in passage area and the rate of pressure rise will be described by FIG. 3.

Figure 5:
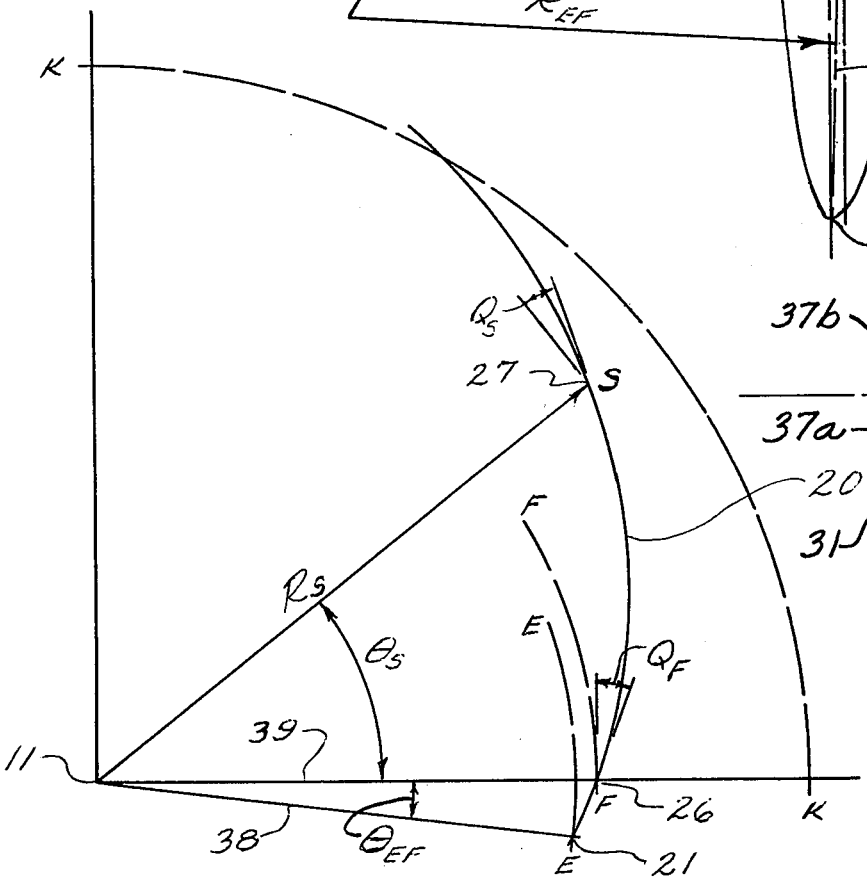
FIG. 5 is a diagram which shows the method of defining the spiral centerline of the diffuser vanes.

In defining the shape of the diffusing passages 17, we first define the spiral vanes, which are shaped in a manner unique to this invention, to be described in FIG. 5, such that the passage breadth between any two adjacent vanes has very little, if any, divergence as shown by the equal arcs 28 and 29. After these spiral vanes are defined, the desired passage flow area is achieved by diverging the side walls 18 and 19 to achieve the diffusion rate specified in FIG. 3. These walls and the vanes 20, thus completely enclose the multitude of identical diffusing air passages. The air then leaves the diffuser passage and is generally collected in an annulus 22 which surrounds the diffuser.

To summarize the diffusion process in another way, the air is diffused in two steps. First, in the vaneless diffuser, and then in the vaned diffuser. It is preferable to have sufficient vaneless diffusion to reduce the air velocity to a slightly subsonic velocity of about 95 percent sonic velocity (Mach No. 0.95) in order to avoid the shock losses of a supersonic inlet. Then it is further diffused in the vaned passages to an exit velocity of 0.1 to 0.3 Mach No. The vaned passage can diffuse more efficiently and with less space requirement than a vaneless diffuser.

Figure 3:
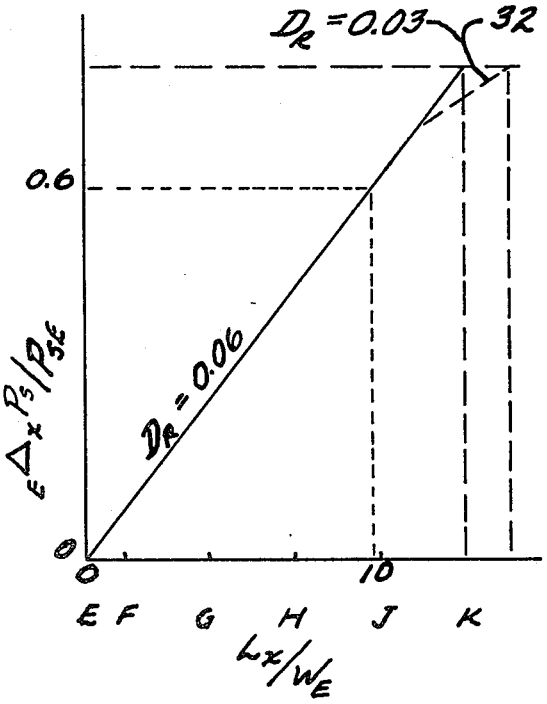
FIG. 3 is a diagram which shows the diffusion rate. This is a plot of the pressure rise ratio in the vaned diffuser passage, plotted against a diffuser length parameter.

While the diffusing passage shape is different if the entrance is supersonic rather than subsonic, the procedure shown in FIG. 3 will apply in either case.

The principles of this invention may be explained most clearly by disclosing the procedure involved in designing a diffuser to meet given design conditions. The size and specific form of the compressor will vary with such parameters as diameter, speed, air flow, pressure, and the like, but such variations do not necessarily affect the design procedure. After these parameters are established, the impeller discharge conditions are then calculated in order to meet the design specifications for the overall compressor.

Figure 4:
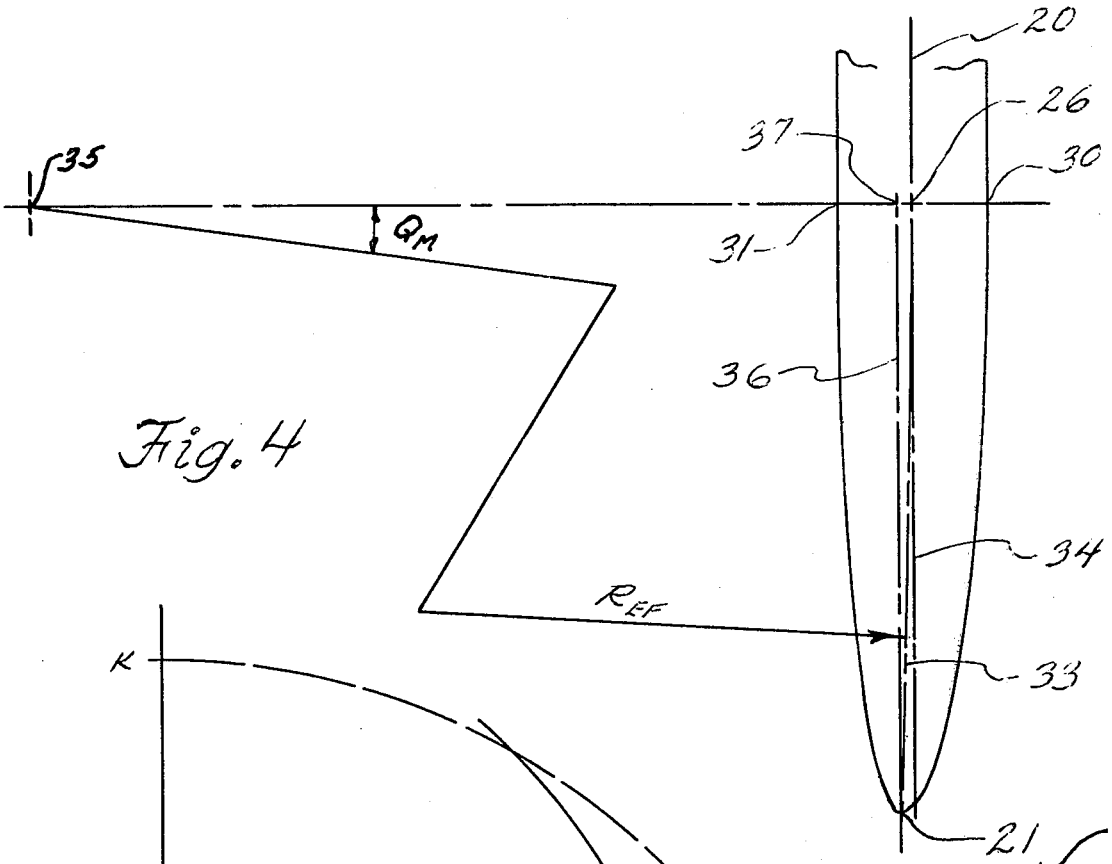
FIG. 4 is an enlarged section of the leading edge contour of a diffuser vane.

By using the procedures described with FIG. 3, 4, and 5, anyone skilled in the art can design a diffuser having the features claimed in this invention.

The first step is to define the conditions at the point of the vane leading edge at $D_E$ (diameter E). By starting with the velocity vectors 14 and 15 at the impeller O.D, similar vectors are calculated at $D_E$. These are shown as a radial velocity vector 23, and tangential vector 24 and the resultant velocity 25. The vaneless annulus width $W_E$ at $D_E$ is defined so that the area, $A_E$ gives a radial velocity 23 which is approximately equal to 14. The tangential whirl component velocity across this free vortex vaneless diffuser is inversely proportional to the diameter. Hence $D_E$ should be selected such that the resultant velocity 25 will be reduced to give a recommended velocity 25 of approximately 0.95 Mach No. It will, therefore, be subsonic at all lesser impeller speed and throughout the entire speed range. In most applications this is desirable. Briefly, it is undesirable to design the maximum speed point for a convergent-divergent passage at supersonic conditions and then operate a large portion of the time at part speed where the velocity is subsonic and a purely divergent passage is desired.

This establishes a starting point for the vaned diffuser design. The overall proportions for the vane leading edge are next established. The vane thickness $T_F$ at $D_F$ is selected by several considerations. In small machines the vane thickness T, may be approximately 2 percent of the impeller diameter and in very large ones about 1 percent. If the vanes are to be milled, this may require a greater thickness on very small machines.

Since the flow angle, $Q_E$ is known at $D_E$, the flow angle must next be established at $D_F$.

In order to calculate $Q_F$ we must first find area $A_F$ by using FIG. 3. Here we find the permissible rate of pressure rise that can be obtained from a diffuser without encountering premature surge. The required surge margin will vary with different applications and it is, therefore, necessary to obtain some experience for each application if it is desired to make the smallest possible diffuser diameter compatible with the best performance. This invention makes it possible to classify each design with a number representing the diffusion rate, $D_R$. This provides a method of evaluating design experience for application to future designs.

The abcissa (horizontal scale) in FIG. 3 is a dimensionless vane length parameter, therefore, scalable for various size machines.

This is based on the ratio $L_x/W_E$,

Where: $L_x$ = the distance from the point of the leading edge at diameter E to any point, x, measured along the vane centerline, $W_E$ = the passage width at the entrance at diameter E.

This ratio is a conventional parameter used in diffuser research.

The ordinate of FIG. 3 is a pressure rise ratio and is likewise dimensionless, therefore, it may be scaled for machines of various pressure. This ratio is based on the pressure rise from the leading edge or entrance, to any point $x$, with respect to the inlet pressure at $D_E$.

This ratio is represented by the symbol, ${}_E\Delta_x P_s / P_{sE}$

Where:

${}_E\Delta_x P_s$ = the static pressure rise (delta P static) from $D_E$ to any selected diameter, $D_x$.

$P_{sE}$ = static pressure at $D_E$. The diffusion rate, $D_R$ is the above pressure rise ratio divided by the diffuser length parameter, which is:

$$D_R = \frac{{}_E\Delta_x P_s / P_{sE}}{L_x / W_E} = \frac{{}_E\Delta_x P_s \times W_E}{L_x \times P_{sE}} = \frac{(P_{sx} - P_{sE})\, W_E}{L_x \times P_{sE}}$$

At any compressor speed where a broad operating range is desired: $D_R \lesseqgtr 0.07$, meaning the above ratio must be equal to or less than this value, which is a dimensionless number. Since it has no units or dimensions, it will apply to any size or pressure compressor with a greater degree of accuracy.

By adhering to this limit, it prevents the occurrence of an excessive pressure gradient, especially near the entrance end of the diffuser passage. Past research and actual compressor experience has indicated this to be a factor in achieving a broad operating range. It is a normal phenomenon that when a compressor is running at a given speed, a reduction in flow will reduce the flow angle of the air approaching the diffuser vanes until a point is reached where the flow separates from the vane and the diffuser ceases to function, at which condition pressure and flow pulsations occur which cause an engine to loose power and under some conditions may be destructive. This pulsation is called "surge." At the other extreme if the flow rate were increased instead of decreased, a point is reached where the pressure output and efficiency drop sharply. This condition is called "choke." With the diffuser design to which this invention relates, it is possible to separate the choke and surge points sufficiently apart that an area of higher efficiency can be used without the danger of encountering the undesirable conditions in any normal operation. There are also other secondary advantages in certain applications.

This design method is very flexible in its use in that the above specified value of the diffusion rate limit may be used for any design speed of the compressor, other than the so-called 100 percent speed, depending on the requirement of a particular engine.

The example shown in FIG. 3 shows a line for $D_R$, for example, which has a slope of 0.06.

On FIG. 3 we must next locate $L_F/W_E$. The diameter, $D_F$, must be determined so that it passes through point 26 which is the junction of the leading edge contour with the centerline of the vane 20. We, therefore, select the length of the eliptical leading edge in order to locate $D_F$. This length, $L_F$, generally equals 4 to 7 times the vane thickness, $T_F$. After locating the length parameter, $L_F/W_E$ on FIG. 3, we find a value for the pressure rise ratio, ${}_E\Delta_F P_s/P_{sE}$ based on the assumed line drawn for the diffusion rate, $D_R$. We then use this pressure ratio to arrive at the area, $A_F$ at $D_F$ by determining the area ratio $A_F/A_E$. This relationship can be derived by the use of formulas or charts familiar to those skilled in the art. Such charts are given in Table I of REF. 3. We then calculate the area $A_F$ to achieve the required static pressure, $P_{sF}$ at $D_F$.

The following equation will determine the equivalent flow area across the cylindrical passage segment at any diameter, $D_x$ $$A_x = \left( \frac{\pi D_x \sin Q_x}{N_v} - T_x \right) W_x$$

where:

$N_v$ = number of diffuser vanes, $T_x$ = vane thickness at any diameter, $D_x$ measured perpendicular to the vane surface.

$W_X$ = passage width at $D_x$

To solve for the flow angle $Q_F$ at $D_F$ in order to determine the required vane angle at the junction 26, with the vane we transpose the above equation, therefore:

$$Q_F = \sin^{-1} \frac{N_v}{\pi D_F} \left( \frac{A_F}{W_F} + T_F \right)$$

At $D_F$ it is desirable to make $W_F = W_E$ and by assuming a value for the number of vanes, $N_v$ we now solve for the vane angle $Q_F$.

It is now possible to define the vane centerline as per FIG. 5. Since we now know the flow angles $Q_E$ and $Q_F$, it is also possible to subsequently define the leading edge contour as per FIG. 4.

Now referring to FIG. 5 we describe the method of defining the vane centerline 20 that will be tangent to the leadng edge origin 26 at $D_F$, and will extend to $D_K$, the exit, and have the characteristics described herein. The use of such a spiral is unique to this invention.

The mathematical curve to be used is a modified logarithmic spiral starting at $D_F$ at a spiral angle $Q_F$. A true log spiral has a constant spiral angle, Q, between the two lines drawn tangent to the spiral and to a circle drawn through that point on the spiral, the center for said circle being the same as for diameter F. In this invention the angle Q decreases as the spiral progress to a larger diameter. In FIG. 5 we draw a spiral by defining a series of points such as 27 at a radius $R_S$, from the center 11, by using a value of the angle $\theta$ (theta) for each point to be defined on the spiral. With $\theta = 0°$, as a starting point the radius $R_S$ is one-half diameter $D_F$ and the spiral angle is $Q_F$, which we have just determined. With the following equation we solve for the radius $R_S$ to a series of points by letting $\theta$ change in some arbitrary increment, such as 5°.

$$R_S = R_F\, e^z$$

Where:

$R_S$ = the radius to any selected points, $s$ on the spiral $R_F$ = the radius to $D_F$, the starting point of the spiral $e$ = a constant, 2.71828

$z = 0.01745\ \theta° \times \tan\ (Q_F - C\ Q_F\ \theta°)$

Where C must be determined by trail and error and will vary generally from 0.0010 to 0.0025 to obtain the desired prallelism of the adjacent vanes. As the value of C increases, the passage breadth 29 will decrease compared to 28. A value for C is selected to give a spiral curve such that the passage breadth at 29 is, zero to 5 percent greater than at 28.

A series of vane spirals can now be defined by rotating about the center axis 11, to define the center lines for the several diffuser vanes which are generally equally spaced. The exact number to vanes to be used is again based on experience and the design requirements of the compressor. Using these spirals 20 as centerlines, the vane surfaces can be added, which will generally, be equidistant on each side, and may be of constant thickness. These three lines will be tangent to the corresponding leading edge lines at 26, 30, and 31.

We now define the passage width, W by positioning the side walls 18 and 19, by the following steps. 1. determine $L_X/W_E$ values at each diameter $D_G$, $D_H$, etc. 2. locate these values on FIG. 3 and run a vertical line to the $D_R$ value selected, than a horizontal line to the ${}_E\Delta_x P_s\ /\ P_{sE}$ value for each point. 3. from Table I, REF. 3, or an equivalent equation determine the area, $A_G$, $A_H$, etc. for each diameter at the respective pressure rise ratio value, $P_s/P_{sE}$. 4. using the above equation for $A_x$ and transposing to solve for $W_x$ (that is, the desired value of W at any point $x$)

$$W_x = A_x \div \left( \frac{\pi D_x \sin Q_x}{N_r} - T \right)$$

solve for the various values of width $W_G$, $W_H$, etc. and define the shape of the walls 18 and 19.

Figure 2:
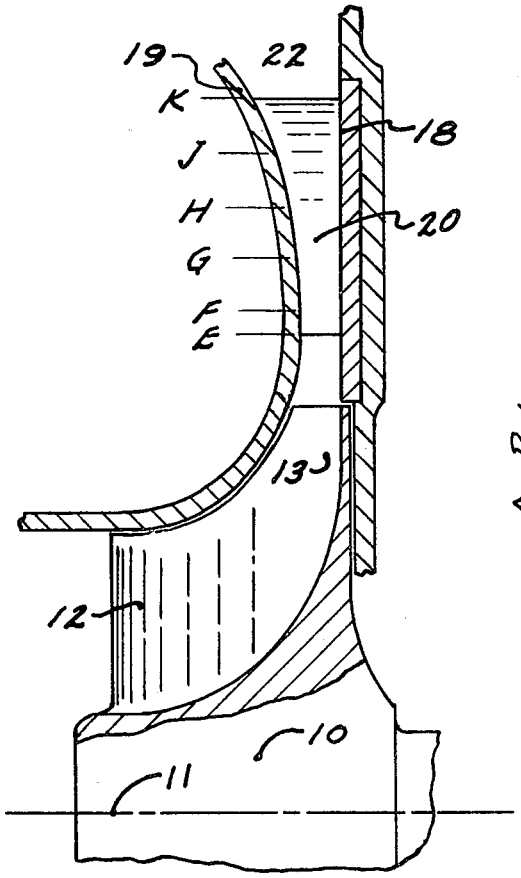
FIG. 2 is a partial radial section view taken through and parallel to the axis of rotation of the rotor.

In FIG. 2, wall 18 is shown flat. This may be convenient for manufacturing reasons, however, it is somewhat better to make the curvature of the two walls as mirror images.

Another feature of the diffusion rate parameter $D_R$, in this invention, is shown by the dotted line 32 in FIG. 3. This feature reduces the diffusion rate, hence it reduces the static pressure gradient immediately before the exit from the diffuser. In as much as the vane exit is also one of the probable localities which initiate flow separation from the vane surface, it may be desirable in some applications to decrease the value of $D_R$ to as low as 0.03 for the last 10 percent to 20 percent of the vane length. The necessity for using this feature will depend on the requirements of the particular compressor design and application.

The next step is to complete the vane leading edge contour. We have defined the air flow angles $Q_F$ and $Q_E$ for each end of the leading edge median line at 21 and 26. We observe that each angle is measured with respect to different reference lines, 38 and 39, and these lines have an angular relation to each other. It is, therefore, necessary to define these angles with reference to a common line. This will permit the construction of the median line and the leading edge edge contour.

In FIG. 5 we show the leading edge point 21, having an angular separation $\theta_{EF}$, between diameters E and F measured at the axis of impeller rotation 11. This angle is calculated by the following equation:

$$\theta_{EF} = \sin^{-1} \left( \frac{L_F \cos Q_F \times 2}{D_E} \right)$$

We use this angle to calculate the radius $R_{EF}$ which is used to define the median line 33, of the leading edge from $D_E$ at 21 to $D_F$ at 26, by the following equation:

$$R_{EF} = \frac{57.3 \times L_F}{Q_E - \theta_{EF} - Q_F}$$

The center, 35 of radius $R_{EF}$ must be located on a line perpendicular to line 34.

In FIG. 4 the median line 33 drawn with radius $R_{EF}$ meets point 26 a distance $L_F$ from point 21. Line 36 is then drawn parallel to line 34 so that it intersects median line 33 at point 21.

Line 36 will be the semi-major axis of two eliptical quadrants having this common semi-major axis but unequal minor axes. The minor axis for the concave side of the diffuser vane is from point 37 to 31, and for the convex side is from point 37 to 30. The sum of the two minor axes must, of course, equal the vane thickness, $T_F$.

Figure 6:
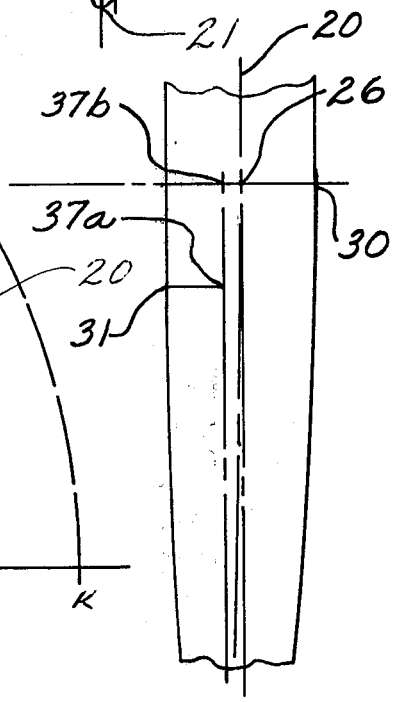
FIG. 6 is similar to FIG. 4 in that it is also an enlarged section of the leading edge contour of a diffuser vane, except that the major axes of the two eliptical quadrants of the contour are of unequal length.

With very high in-flow Mach No. at the vane leading edge 21, it may be desirable to have a sharper leading edge in which case FIG. 6 shows a configuration for the leading edge contour having unequal lengths for the semi-major axes. This may be desirable in some designs, in which case the geometric centers of elipse quadrants are located at points 37*a* and 37*b*. In defining a leading edge of this type, the length $L_F$ is measured from point 21 to 37*b* in FIG. 6 and all the procedures use 37*b* in place of 37, except for defining the eliptical quadrant on the concave side of the vane which will use point 37*a*.

This completes the construction of the diffuser contours as defined by the preferred embodiment of this invention.

I claim:

1. A centrifugal compressor having a group of diffusing flow passages bounded by two generally radial side walls and by a group of vanes having a generally tangential direction mounted between the two side walls thus defining the diffusing flow passages, each passage having an entrance at a diameter "E" and an exit at some larger diameter, each passage having a predetermined area at the entrance and a predetermined area at the exit greater than the area at the entrance, wherein the improvement comprises a progressive variation of passage area from entrance to exit according to a specified area schedule so as to control the diffusion rate to a value less than 0.07 and to cause a relatively constant change in the pressure rise ratio for each unit of flow path length; the said area schedule and diffusion rate being defined according to the formula, $$\text{Diffusion Rate, } D_R = \frac{\text{Pressure Rise Ratio}}{\text{Diffuser Length Parameter}}$$

$$\text{where, Pressure Rise Ratio} = \frac{P_{sx} - P_{sE}}{P_{sE}},$$

$$\text{Diffuser Length Parameter is } \frac{L_x}{W_E}.$$

$P_{sx}$ is static pressure at any point $x$ selected along the diffuser passage, $P_{sE}$ is static pressure at the diffuser entrance at diameter E, $L_x$ is diffuser path distance from the entrance at diameter E to the point $x$ measured along the diffuser vane centerline, and $W_E$ is diffuser passage width at the diffuser entrance at diameter E measured between the side walls perpendicularly to the flow path.

2. A radial diffuser having the divergence characteristics of the vanes and side walls, wherein the spirally shaped diffuser vanes having a centerline with a spiral angle at the diffuser entrance and a lesser spiral angle at the diffuser exit, and having a centerline shaped essentially according to the following polar equation:

$$R_s = R_E e^z$$

Where, $R_s$ = the radius from the geometric center of the diffuser diameter, to any selected point $s$ on the spiral $R_E$ = the radius from said center to a point E the starting point of the spiral, $e$ = a well known mathematical constant 2.71828, $z = 0.01745\ \theta^\circ \times \tan\ (Q_E - CQ_E\theta^\circ)$ Where, $\theta^\circ$ = the angular distance between the two radial lines, one from the centerpoint to point E and the other being a radial line from the centerpoint to point $s$ on the spiral $Q_E$ = spiral angle at point E C = an arbitrary value between 0.0025 and 0.0015 determined by trial and error to obtain (the desired) parallelism between adjacent vanes.

* * * * *